US005762574A

United States Patent [19]

Mashburn

[11] Patent Number: 5,762,574

[45] Date of Patent: Jun. 9, 1998

[54] HUNTING ARROW AND METHOD

[76] Inventor: Larry J. Mashburn, 1869 Sullivan Rd., Thomasville, N.C. 27360

[21] Appl. No.: 783,088

[22] Filed: Jan. 14, 1997

[51] Int. Cl.[6] ..... F41B 5/02

[52] U.S. Cl. ..... 473/581

[58] Field of Search ..... 473/578, 581, 473/582–585; 43/6

[56] References Cited

U.S. PATENT DOCUMENTS

| | | | |
|---|---|---|---|
| 1,498,741 | 6/1924 | Loop | 43/6 |
| 3,396,660 | 8/1968 | Bilson et al. | 473/581 X |
| 4,103,893 | 8/1978 | Walker | 473/581 |
| 4,166,619 | 9/1979 | Bergmann et al. | 273/106.5 |
| 4,175,749 | 11/1979 | Simo | 473/584 |
| 4,182,327 | 1/1980 | Haley | 473/581 X |
| 4,452,460 | 6/1984 | Adams | 473/584 |
| 4,463,953 | 8/1984 | Jordan | 473/581 |
| 4,541,636 | 9/1985 | Humphrey | 273/416 |
| 4,729,320 | 3/1988 | Whitten, III | 473/583 X |
| 4,856,792 | 8/1989 | Hardison | 273/416 |
| 4,944,520 | 7/1990 | Fingerson et al. | 473/582 |
| 5,086,749 | 2/1992 | Ekstrom | 43/6 X |

FOREIGN PATENT DOCUMENTS

| | | | |
|---|---|---|---|
| 82729 | 11/1953 | Norway | 43/6 |
| 165478 | 6/1921 | United Kingdom | 43/6 |

OTHER PUBLICATIONS

1996 Archery Catalog –pp. 28 through 31.

*Primary Examiner*—Mark S. Graham

[57] ABSTRACT

A hunting arrow is provided having a hollow shaft with an inlet valve for pressurization with compressed air. A release valve permits the compressed air to escape internally of the target causing extensive interior damage thereto. The arrow can be pressurized by the use of a bicycle pump, air compressor or other conventional sources.

18 Claims, 2 Drawing Sheets

HUNTING ARROW AND METHOD

BACKGROUND OF THE INVENTION

1. Field of the Invention

The instant invention pertains generally to arrows used for hunting, and pertains specifically to hunting arrows having shafts containing a pressurized gas.

2. Description of Related Art and Objectives of the Invention

Modern hunting arrows can be fitted with a variety of different types of broad heads. The selection of an appropriate broad head is critical to a humane, efficient kill of a game animal. As shown by the variety of broad heads currently available on the archery market, the industry has expended considerable effort toward developing more effective arrows and broad heads. Much of this effort is directed to maximizing the cutting effect of the broad head to increase the chances of severing a major blood vessel, thus promoting a quick, humane kill.

Broad heads are currently available in a variety of shapes and configurations. Of particular interest are broad heads that contain expandable cutting apparatuses that deploy upon impact to enhance the broad head's cutting effect. However, these cutting apparatuses must be kept sharpened, cleaned, and lubricated for maximum efficiency. Such maintenance can be burdensome and time-consuming. Thus, there exists a need for a hunting arrow having apparatus that deploys upon or soon after impact and does not require excessive sharpening and other burdensome upkeep.

The instant invention addresses this need by providing a hunting arrow having a hollow shaft for storing a highly-pressurized gas and means for releasing that pressurized gas upon penetration, to thereby use the escaped pressurized gas to enhance the cutting effectiveness of the hunting arrow. U.S. Pat. No. 4,541,636 discloses an arrow shaft that is pressurized to enhance the arrow's rigidity during flight. However, this arrow does not disclose any pressure-release means deployed upon the arrow's impact.

Thus, a first objective of this invention is to provide a hunting arrow having a hollow shaft capable of storing a highly pressurized gas and having means for releasing that gas upon the arrow's penetration into a game animal.

A second objective is to provide a hunting arrow having an inlet valve used to pressurize the hollow shaft.

A third objective is to provide a hunting arrow having a release valve that is activated when the arrow penetrates a target to depressurize the hollow shaft.

A fourth objective is to provide a release valve assembly having an adaptor and a release valve.

A fifth objective is to provide an arrow having a release pin joined to a release valve that contacts the inlet valve to depressurize the hollow shaft.

Various other objectives and advantages of the present invention will become apparent to those skilled in the art as a more detailed description is set forth below.

SUMMARY OF THE INVENTION

A hunting arrow is provided having a hollow shaft, having means for pressurizing the shaft and having means for depressurizing the shaft when the arrow penetrates the target. The hollow shaft includes a gas inlet valve for pressurizing the shaft using any suitable conventional compressor.

The arrowhead assembly provides an adaptor, a broad head, and a release valve. The adaptor comprises an elongated extension for receiving the broad head, and a cylindrical section for slidably carrying the release valve. The adaptor also defines two opposing elongated slots, and two opposing gas outlets.

The release valve comprises a hollow cylinder, a trigger pin disposed diametrically across the hollow cylinder, and a plurality of fins radially disposed along the outside surface of the hollow cylinder. The trigger pin passes through both elongated slots on the adaptor when the adaptor and the hollow cylinder are assembled, and joins on each of its ends to the hollow cylinder. The hollow cylinder, and thus the release valve, can slide along the cylindrical section of the adaptor between a forward and rearward position. In the release valve's forward position, the two outlets are sealed; in the release valve's rearward position, the two outlets are open. When the release valve is in its most rearward position, the trigger pin presses against the inlet valve to depressurize the hollow shaft, and the high-pressure gases exit through the outlets.

In use, the arrow is first disassembled by removing the arrowhead from the shaft, the hollow shaft is then pressurized, and the arrow is then re-assembled. The arrow is then fired at a target. When the broad head penetrates a target, the fins on the release valve contact the target, forcing the release valve rearwardly, exposing the gas outlets, while driving the trigger pin against the inlet valve. The inlet valve depressurizes the hollow shaft, releasing high-pressure gases that exacerbate the wound caused by the broad head, resulting in a quicker, more humane kill.

DETAILED DESCRIPTION OF THE PREFERRED EMBODIMENT AND OPERATION OF THE INVENTION

Figure 1:
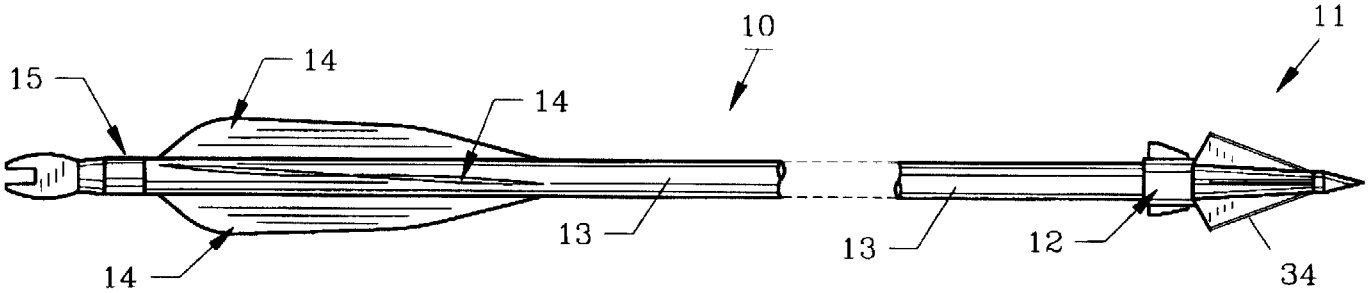
FIG. 1 is a fragmented view of hunting arrow of the invention.

The preferred form of the invention, hunting arrow 10, is shown in fragmented form in FIGS. 1–6. As shown in FIG. 1, arrow 10 includes arrowhead assembly 11, release valve 12, hollow shaft 13, feathers 14 and nock 15. Shaft 13 is hollow and is formed of aluminum in the preferred embodiment. Alternative embodiments employ fiberglass, or other materials suitable for maintaining a compressed gas in a pressurized state for extended periods. Feathers 14 and nock 15 are conventional and may be formed from suitable conventional materials. Release valve 12 provides a means for depressurizing hollow shaft 13.

Figure 2:
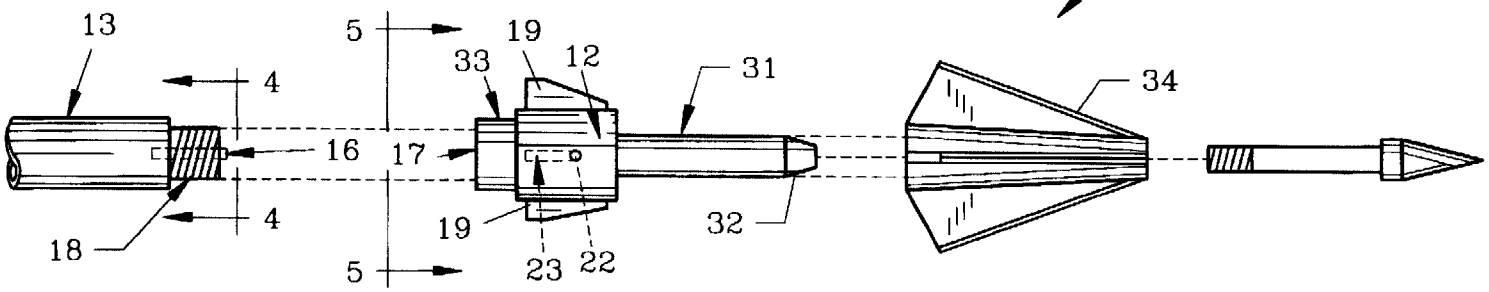
FIG. 2 is an exploded, fragmented view of the hollow shaft, release valve, adaptor, and broad head of the invention, with the release valve in its forward or closed position.
Figure 3:
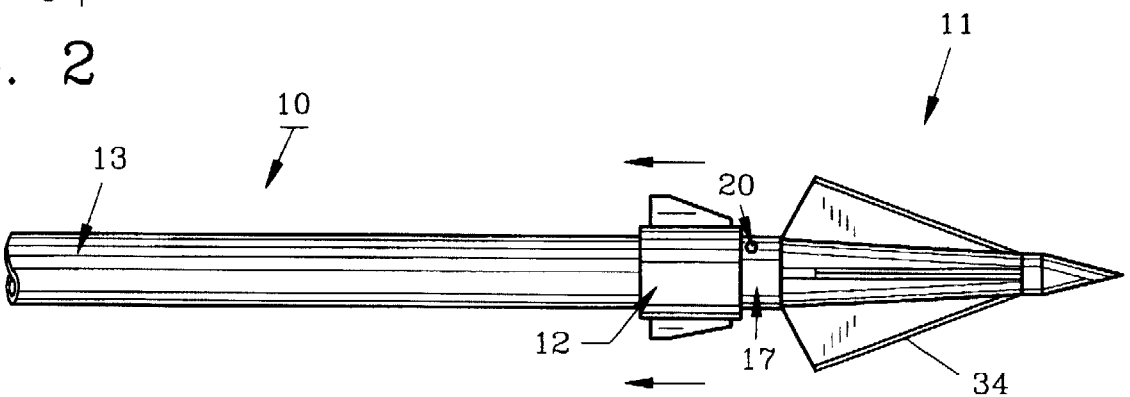
FIG. 3 is a fragmented view of the release valve of the invention in the rearward or open position.
Figure 6:
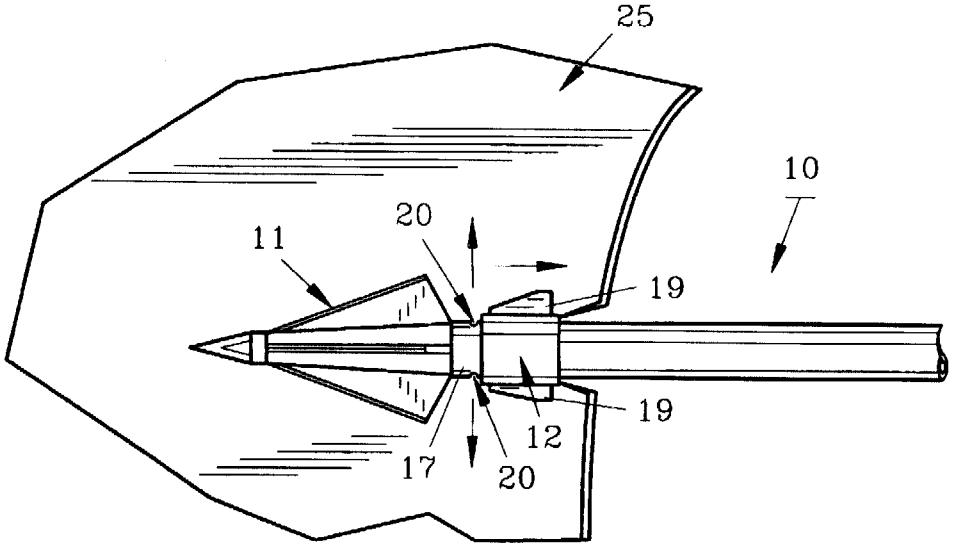
FIG. 6 is a diagram of the arrow of the invention penetrating a target and activating the release valve.

As shown in FIG. 2, hollow shaft 13 includes threaded end 18, which is exteriorly threaded for engaging arrowhead assembly 11. Arrowhead assembly 11 includes adaptor 31. Adaptor 31 includes an elongated extension 32, which receives a broad head, and a hollow cylindrical section 33, which engages threaded end 18. Cylindrical section 33 defines shaft socket 17, which is interiorly threaded for engaging threaded end 18. Cylindrical section 33 defines two opposing elongated slots 23 and 23' (23' not seen in FIG. 2), which run parallel to the axis of cylindrical section 33. Cylindrical section 33 also defines two opposing outlets 20 and 20', as seen in FIGS. 3 and 6.

Release valve 12 has a hollow cylindrical cross-section, and fits around cylindrical section 33 to selectively expose or conceal outlets 20 and 20'. Release valve 12 is joined to trigger pin 22, which passes through elongated slots 23 and 23' of cylindrical section 33. Thus, release valve 12 travels freely between a forward position closing outlets 20 and 20', and a rearward position opening outlets 20 and 20'. FIGS. 2 and 3, respectively, illustrate the closed and open position of release valve 12. The travel of release valve 12 is limited by the length of elongated slots 23 and 23'. Release valve 12 includes a plurality of fins 19, which are radially disposed about release valve 12, which fins 19 serve to activate release valve 12, as explained further below.

Hollow shaft 13 includes inlet valve 16, which is a spring-loaded inflation valve conventionally used for tires and other items. Inlet valve 16 provides means for pressurizing hollow shaft 13. Hollow shaft 13 may be pressurized with any suitable gas. In the preferred embodiment, the gas is air. As shown in FIG. 2, the valve core of inlet valve 16 extends slightly beyond threaded end 18 of hollow shaft 13. This extended position of inlet valve 16 allows it to contact trigger pin 22 when release valve 12 is near its rearward position. When release valve 12 travels to its rearward position, trigger pin 22 presses inlet valve 16 and releases the compressed gas stored in hollow shaft 13. The compressed gas then flows through shaft socket 17 and exits through outlets 20 and 20'. Outlets 20 and 20' are thus in fluid communication with shaft socket 17 and hollow shaft 13.

Hollow shaft 13 is pressurized with a compressed gas, such as air, to a selected pressure using a standard bicycle pump or compressor. The selected pressure may be chosen according to the circumstances, but a pressure of approximately 150 p.s.i. is preferred. After pressurizing, hollow shaft 13 may be screwed to arrowhead assembly 11, and arrow 10 is then ready for use. Generally, arrow 10 is fired at a game animal by a suitable bow, and when arrow 10 strikes the animal, arrowhead assembly 11 penetrates the animal, inflicting a substantial laceration wound. When fins 19 contact the animal, release valve 12 is forced to its rearmost position, causing trigger pin 22 to release the highly pressurized gas from hollow shaft 13 through outlets 20 and 20'. The exiting gas exacerbates the localized wound inflicted by arrowhead assembly 11, increasing the damage to nearby tissue and blood vessels, thereby promoting a quick and humane kill.

FIG. 3 illustrates hollow shaft 13 joined to arrowhead assembly 11, with release valve 12 slid rearward to expose outlet 20. In this position, release valve 12 would cause inlet valve 16 to depressurize hollow shaft 13 with high pressure gas exiting through outlets 20 and 20'.

Figure 5:
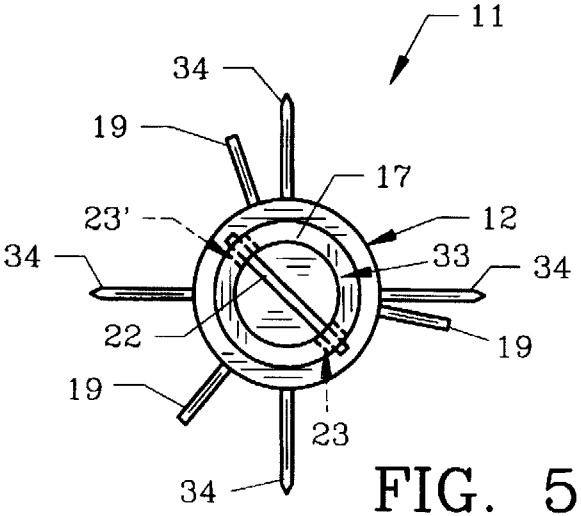
FIG. 5 is an end view of the arrowhead assembly taken along the lines 5—5 in FIG. 2.
Figure 4:
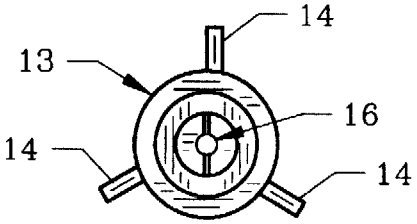
FIG. 4 is an end view of the hollow shaft taken along the lines 4—4 in FIG. 2.

FIG. 4 is an end view of hollow shaft 13, featuring feathers 14 and inlet valve 16. FIG. 5 is an end view of arrowhead assembly 11, featuring trigger pin 22, release valve 12, elongated slots 23 and 23', shaft socket 17, blades 34 of arrowhead assembly 11, and fins 19. Note that fins 19 are radially mis-aligned relative to blades 34. This radial mis-alignment ensures that fins 19 will contact unlacerated areas of the game animal, thus allowing fins 19 to push release valve 12 rearwardly.

FIG. 6 is a schematic view of arrow 10 penetrating game animal 25, with arrowhead assembly 11 cutting a wound channel, and with fins 19 contacting game animal 25 to drive release valve 12 rearward, in turn depressurizing hollow shaft 13. High pressure gas is shown exiting through outlets 20 and 20'.

The preferred method of using the invention comprises unscrewing arrowhead assembly 11 from hollow shaft 13, pressurizing hollow shaft 13 with a suitable pump, reassembling arrowhead assembly 11 to hollow shaft 13, and firing arrow 10 at game animal 25. When arrow 10 strikes and penetrates game animal 25, fins 19 and release valve 12 are driven rearwardly, causing trigger pin 22 to press inlet valve 16, thus depressurizing hollow shaft 13. The high-pressure gases exit through outlets 20 and 20' and exacerbate the wound inflicted by arrow 10. In the event that arrow 10 is not fired at game animal 25 after hollow shaft 13 is pressurized, arrow 10 may be disassembled and hollow shaft 13 may be manually depressurized to avoid fatiguing the material comprising hollow shaft 13.

The illustrations and examples provided herein are for explanatory purposes and are not intended to limit the scope of the appended claims.

I claim:

1. A hunting arrow comprising:

(a) a pressurizable shaft;

(b) an arrowhead assembly joined to said pressurizable shaft;

(c) means for depressurizing said shaft upon arrow penetration, said depressurizing means comprising a release valve, and a fin, said fin radially disposed relative to said release valve, said depressurizing means mounted on said pressurizable shaft; and (d) means for pressurizing said shaft, said pressurizing means attached to said pressurizable shaft.

2. The arrow of claim 1, wherein said pressurizing means is positioned on one end of said shaft.

3. The arrow of claim 1, wherein said pressurizing means comprises an air inlet valve.

4. The arrow of claim 2, wherein said release valve is positioned proximate said pressurizing means.

5. The arrow of claim 4, wherein said release valve has a cylindrical cross-section.

6. The arrow of claim 2, wherein said arrowhead assembly comprises an adaptor for threadably receiving said shaft.

7. The arrow of claim 6, wherein said adaptor defines an elongated slot.

8. The arrow of claim 6, wherein said adaptor defines a gas outlet.

9. The arrow of claim 8, wherein said depressurizing means is slidably positioned on said adaptor to selectively open and close said outlet.

10. A method for killing game with an arrow having an arrowhead and a release valve, said release valve having a fin, comprising the steps of:

(a) pressurizing the arrow with a gas through an intake valve;

(b) penetrating the game with the arrow;

(c) striking the body of the game with the fin; and (d) releasing the gas into the game after the arrowhead has fully penetrated the game.

11. The method of claim 10 further comprising the step of withdrawing the arrow from the game.

12. The method of claim 10 wherein the step of releasing the gas comprises releasing a pressurized stream of compressed air.

13. The method of claim 10 further comprising the step of pressurizing the arrow with compressed air.

14. The method of claim 13 wherein the step of pressurizing the arrow comprises pressurizing the arrow to a pressure of 150 psi.

15. A release valve assembly for use with a hollow arrow shaft and an arrowhead, the hollow shaft containing pressurized gas and having an inlet valve, said release valve assembly comprising:

(a) an adaptor, said adaptor comprising a cylindrical section and an elongated extension joined to said cylindrical section, said cylindrical section defining an elongated slot and an outlet, said cylindrical section defining a socket for receiving the arrow shaft, said elongated extension for receiving the arrowhead;

(b) a release valve, said release valve being hollow and having a cylindrical cross-section, said release valve being slidably positioned on said cylindrical section;

(c) a trigger pin joined to said release valve and passing through said elongated slot, said trigger pin and said release valve being selectively, slidably carried by said elongated slot from a forward to a rearward position, said trigger pin contacting the inlet valve when said release valve is in its rearward position to depressurize the arrow shaft through said outlet; and (d) a fin joined to said release valve and being radially disposed, said fin for contacting the target after the arrowhead has penetrated the same.

16. The release valve assembly of claim 15, wherein said cylindrical section defines a pair of opposing elongated slots and a pair of opposing outlets.

17. The release valve assembly of claim 16, wherein said trigger pin passes through both elongated slots.

18. The release valve assembly of claim 15, further comprising a plurality of fins radially disposed relative to said release valve and joined thereto.

* * * * *